US006069204A

United States Patent [19]

Stroud, Jr. et al.

[11] Patent Number: 6,069,204

[45] Date of Patent: May 30, 2000

[54] MONOFILAMENT MADE FROM A BLEND OF A POLYESTER HAVING A POLYHYDRIC ALCOHOL COMPONENT OF 1,4-CYCLOHEXANEDIMETHANOL, A POLYAMIDE, AND A POLYOLEFIN

[75] Inventors: Herbert Dewey Stroud, Jr., Rutherfordton, N.C.; Paul R. Cadmus, Spartanburg, S.C.

[73] Assignee: Johns Manville International, Inc., Denver, Colo.

[21] Appl. No.: 08/371,311

[22] Filed: Jan. 11, 1995

Related U.S. Application Data

[63] Continuation of application No. 08/118,705, Sep. 9, 1993, abandoned.

[51] Int. Cl.[7] ..... D01F 6/92

[52] U.S. Cl. ..... 525/166; 525/177; 442/199; 442/361

[58] Field of Search ..... 525/166; 428/224; 442/199, 361

[56] References Cited

U.S. PATENT DOCUMENTS

| | | | |
|---|---|---|---|
| 2,901,466 | 8/1959 | Kibler et al. | 260/75 |
| 4,423,543 | 1/1984 | Leuvelink | 49/433 |
| 5,162,151 | 11/1992 | Smith et al. | 428/364 |
| 5,162,152 | 11/1992 | Rashbrook | 428/364 |
| 5,169,499 | 12/1992 | Eagles et al. | 428/175 |
| 5,270,401 | 12/1993 | Sham | 525/140 |

FOREIGN PATENT DOCUMENTS

| | | |
|---|---|---|
| 0554979 | 8/1993 | European Pat. Off. . |
| 4307392 | 4/1994 | Germany . |
| 1040470 | 11/1964 | United Kingdom . |
| WO90/12918 | 11/1990 | WIPO . |

OTHER PUBLICATIONS

Albany International Fabric Facts, vol. 38 No. 4–6 "Thermonetics High–Temp Fabrics For High–Tech Machines".

*Primary Examiner*—Patricia A Short
*Attorney, Agent, or Firm*—Robert D. Touslee

[57] ABSTRACT

The present invention is directed to a monofilament made from a blend of a polyester having a polyhydric alcohol of 1,4-cyclohexane-dimethanol, a polyamide, and a polyolefin. This blend is useful as an article of paper making machine clothing when the blend is in the form of a fiber structure. Particularly, this blend is useful in spiral fabrics having good dry-heat strength and hydrolysis resistance.

12 Claims, No Drawings

MONOFILAMENT MADE FROM A BLEND OF A POLYESTER HAVING A POLYHYDRIC ALCOHOL COMPONENT OF 1,4-CYCLOHEXANEDIMETHANOL, A POLYAMIDE, AND A POLYOLEFIN

This is a continuation of application(s) Ser. No. 08/118,705 filed on Sep. 9, 1993, now abandoned.

FIELD OF THE INVENTION

The present invention is directed to a monofilament made from a blend of a polyester having a polyhydric alcohol component of 1,4-cyclohexanedimethanol, a polyamide, and a polyolefin. This invention is useful in an article of paper making machine clothing when the blend is in the form of a fiber structure. This invention is particularly useful in spiral fabrics.

BACKGROUND OF THE INVENTION

Paper is composed of cellulosic fibers that are formed into a sheet. A paper making machine generally consists of three main sections: the forming section, the pressing section, and the drying section.

In the forming section, the cellulosic pulp slurry or furnish is injected onto a forming fabric which is a long, woven mesh belt. As the forming fabric moves along through the forming section, some of the water in the slurry drains through the fabric and a paper web is formed. As this paper web leaves the forming section, it is composed of about 80% water and about 20% solids. For many years, forming fabrics were woven from metal wires and had a life of about one week on a paper machine. This short life was due to metal fatigue and abrasion caused by contacting the machine parts in the forming section. In the 1960's, experiments were begun to replace the metal fabrics with woven, synthetic, monofilament yarn fabrics. Today, polyester monofilament is the yarn of choice for this application and typical fabric life is about 60–120 days.

After leaving the forming section, the paper web moves into the pressing section where a high compressive force is exerted by a pair of press rolls to remove more water from the paper web. The press fabric serves as cushioning and water removing media between the press rolls. As the paper leaves the pressing section, the paper web contains about 60% water and 40% solids.

Traditionally, press fabrics were made of 100% wool due to its resilience and water absorbency. However, synthetics have been developed with good resilience that have longer life than woolen felts. Fabrics of choice today consist of a base fabric, woven from polyamide monofilaments, into which polyamide fibers have been needlepunched to form a felt. Typically life of press felts is 30–60 days.

The drying section consists of large, steam-heated cylinders that dry the paper web to a level of about 6% moisture.

A dryer felt or fabric is needed to hold the paper in contact with the dryer cylinders. Originally, these fabrics were made from cotton, but as paper making developed, higher speed and temperature shortened the life of the cotton dryer felts.

Many different fibers and yarns have been used to develop better-performing dryer felts so as to improve the efficiency of the paper making process. Presently, the predominant yarn used in the manufacture of dryer fabrics is polyester monofilament. See, Luciano, B., *Albany International Fabric Facts*, Volume 38, No. 4–6. Dryer fabrics made from polyester monofilament operating at normal temperatures (300° to 350° F.) last about one year.

In order to improve profitability, paper makers desire to increase speeds of the paper making machines. To sufficiently dry the paper at increased throughput, additional heat is used in the dryer section and perhaps in other sections of the paper machine as well.

Elevated temperatures tend to adversely affect the hydrolysis resistance of polyester yarns. For this reason manufacturers of dryer fabrics have looked at other fibers and yarns in an effort to increase fabric life at higher temperatures.

Moreover, if a fabric has to be replaced at other than scheduled maintenance cycles due to failure or damage, the downtime cost to the paper maker can be significant. For this reason, it is desirable to manufacture dryer fabrics that will run with longer and more predictable times under increased heat and speed conditions.

As we move into the next century, an ever increasing emphasis is being put on using recycled paper in the making of new paper. Federal and state laws are being passed which require a certain amount of recycled paper to be used in each pound of paper manufactured. For the environmentalist this is a good law, however, for the paper makers this law poses new challenges because the recycled paper has a high level of contaminants. Contaminants include wood pulp residues, inorganic residues (such as clays and titanium dioxide), adhesives from mailing labels, stickers from hot-melt adhesives, non-paper films, and printing inks. These contaminants may either stick to the paper making fabrics or be carried on through the paper machine in the paper sheet. If these contaminants cannot be easily removed, the fabrics will become plugged and the quality of the paper will decrease to the point that the fabric must be replaced. Due to the ease of cleaning, fabrics made from 100% monofilaments are desired. See: Luciano, B., Ibid.

One solution is to use polyphenylene sulfide (PPS) monofilaments in the manufacture of dryer felts. PPS has very good hydrolysis resistance, but unfortunately, the polymer is difficult to extrude into monofilaments and is quite expensive. Also, PPS monofilaments are very brittle which can cause problems on the paper machine. An example of a PPS monofilament is found in U.S. Pat. No. 5,162,151, which is incorporated herein by reference.

Another fiber solution to the harsh environment of the paper making process is the use of poly(2-methyl-1,5-pentylene) terephthalamide. See U.S. Pat. No. 5,162,152, which is incorporated herein by reference. Yet another fiber solution is the use of a copolymer of terephthalic acid, isophthalic acid, and 1,4-dimethylocyclohexane (also referred to as 1,4-cyclohexanedimethanol). See: U.S. Pat. No. 5,169,499, which is incorporated herein by reference. Another fiber solution is the use of an alloy of a polyester (terephthalic acid and 1,4 dimethylocyclohexane) and polyamide. See: U.S. patent application Ser. No. 08/053,120 filed Apr. 26, 1993, which is incorporated herein by reference.

Accordingly, there is a need in the paper making industry to develop new fibers for use in paper making clothing.

SUMMARY OF THE INVENTION

The present invention is directed to a monofilament made from a blend of a polyester having a polyhydric alcohol of 1,4-cyclohexanedimethanol, a polyamide, and a polyolefin. This blend is useful as an article of paper making machine clothing used in forming, pressing, or drying sections of a paper making machine when the blend is in the form of a fiber structure. The blends usefulness stems from its dry-heat strength, hydrolysis resistance, and ability to be formed into spiral fabrics.

DESCRIPTION OF THE INVENTION

The inventive blends disclosed herein include a polyester having a polyhydric alcohol component of 1,4-cyclohexanedimenthanol, a polyamide, and a polyolefin. The blend may include about 70 to about 95 percent by weight of the polyester, and about 5 to about 20 percent by weight of the polyamide, and about 1 to about 6 percent by weight of the polyolefin. The blend preferably includes about 85 to about 95 percent by weight of the polyester, and about 5 to about 15 percent by weight of polyamide, and about 1 to about 3 percent by weight of the polyolefin. Additionally, the blend may include a hydrolysis stabilizing agent. The hydrolysis stabilizing agent may comprise about 0.5 to about 5 percent by weight of the blend, preferably it comprises about 1.0 percent by weight of the blend. The blend may also include a thermo-oxidative stabilizing agent. The thermo-oxidative stabilizing agent may comprise about 0.05 to about 10 percent by weight of the blend. If used, it preferrably comprises about 5 percent by weight of the blend.

The term "monofilament", as used herein, is directed to any single filament of a manufactured fiber usually of a denier higher than 14. The term "shaped article", as used herein, is directed to articles which are made by extrusion or molding techniques, including, but not limited to, fibers, films, injection molded articles, and blow molded articles.

The term "polyester having polyhydric alcohol component of 1,4-cyclohexanedimethanol", as used herein, is directed to, but not limited by the polyester material disclosed and claimed in U.S. Pat. No. 2,901,466, which is incorporated herein by reference. The polyfunctional acid component may be selected from, but is not limited to, the group of: isophthalic acid; terephthalic acid; derivatives of isophthalic acid; derivatives of terephthalic acid; and combinations thereof. These polyester may be referred to as polycyclohexlandymethanol terephthalate (PCT)—a polyester from the condensation reaction of cyclohexanedimethanol (CHDM) and terephthalatic acid or its derivatives, or PCTA—the condensation product of CHDM, terephthate acid and isothalic acid. Each of the foregoing products are commercially available from the Eastman Chemical Co., of Kingsport, Tenn. under the tradename Eastman 3879 (the PCT product) and "KODAR" THERMX Copolyester Type 13319 (the PCTA product). The PCTA material is preferred. The fiber processability of these materials may be improved by the addition of a minor portion of polyethylene terephthalate. See: British Patent Specification No. 1,040,470 incorporated herein by reference.

The term "polyamide", as used herein, is directed to any of the known polyamide polymers. The polyamide improves the dry-heat strength and hydrolysis resistance of the yarns made from the blend. Exemplary polyamides include, but are not limited to: nylon 6; nylon 6,10; nylon 6,12; nylon 11; nylon 12; nylon 4,6; nylon 6,T; nylon 6,6; and combinations thereof. Nylon 6,6 is preferred. The foregoing nylon materials are commercially available from the Engineering Plastic Division of the Hoechst Celanese Corporation, Summit, N.J.

The term "polyolefin", as used herein, is directed to any of the known polyolefin polymers. The polyolefin appears to improve the ability of the fiber to be formed into a spiral yarn. Exemplary polyolefins include, but are not limited to: polyethylene, polypropylene, polyoctene and copolymers thereof. A copolymer of ethylene/octene is preferred. These materials are commercially available from Dow Chemical Company, Atlanta, Ga. under the tradename of "ASPUN".

The term "hydrolysis stabilizing agent", is used herein, refers to an "endcapping agent". Endcapping agents are used to prevent degregation of the polyester polymer. This particular form of degradation results from hydrolysis. Exemplary hydrolysis stabilizing agents include the class of chemicals known as carbodiimides. A preferred carbodiimide is known chemically as 2,6-diisopropylphenyl carbodiimide. Such carbodiimides are commercially available under the tradename "STABAXOL", "STABAXOL P", "STABAXOL P-100" from the Rhein Chemie GmbH of Rheinau, Federal Republic of Germany and "CARBO D" from BASF of Parsippany, N.J. "CARBO D" is preferred.

The term "thermo-oxidative stabilizing agent", as used herein, refers to a material added to prevent degradation of the polyester when subjected to hot dry heat. The preferred material is sold under the commercial name of "KODAR" THERMX 13319 L0001 from the Eastman Chemical Co. of Kingsport, Tenn.

The alloy monofilaments, disclosed herein, is particularly suited for spiraling end uses. Spiraling end uses refer to, for example, fabrics, made from spiraled monofilaments, that may be used in conveyor belts, lay belts, dryer fabrics for paper machines and the like. Spiraled fabrics refer to the following, for example: A monofilament is passed through a spiraling machine in order to make an oval shaped spiral. In this spiraling machine the monofilament is heated and then wrapped around a mandrel of a specific shape. As new monofilament comes into the spiraling machine and is spiraled, the cooled monofilament wrapped around the mandrel is pushed off the end of the mandrel. These spiraled monofilament coils are then meshed together and a pintle yarn is passed through the intermeshed coils to form an interlocked structure. An entire fabric is constructed by building up the number of coiled structures that are fastened together by pintle yarns. In the open space between the pintle yarns, it is possible to insert an additional monofilament in order to control the air permeability of the fabric. After the fabrics are made, they are heat set in order to fix the dimensional stability. A fabric made from spiraled coils is attractive because it costs less than a woven fabric of similar dimensions. It is also possible to repair a defect in the fabric made from spiraled monofilaments by removing the pintle yarns on either side of the defect, removing the defective portion of the fabric, and inserting a new section in place of the part that was removed. See generally, U.S. Pat. No. 4,423,543 which discusses spiral fabrics, and which is incorporated herein by reference.

Other details and aspects of the invention are more fully described in the examples set forth hereinafter. Weights are given as weight percent unless otherwise noted.

EXAMPLE

In the following example, the manufacture of the present invention and its physical properties are illustrated. The components and weight percentages of the tested blends are as follows: PCTA (THEMRX 13319)—87%; Nylon (N186 from Hoechst Celanese)—10%; polyolefin (ASPUN 6830A, ethylene-1-octene copolymer with 0.1% maleic anydride and 0.05% calcium sterate)—2%; and hydrolysis stabilizing agent (BASF Carbo D)—0.9%

The polyester resins are dried to remove moisture. The moisture content of the dried resins should be less than 0.007%. The resins are then transferred into an oxygen free hold vessel located above a three heated zone, single screw extruder. Zone 1 was heated to 299° C., Zone 2 to 305° C., and Zone 3 to 305° C. The resins are gravity fed into the extruder. Other components of the blend, including the polyamide resins and polyolefin resins, are added by metering devices when the resins are gravity fed into the extruder. While in the extruder, all components of the blend are melted and intimately mixed. The blend is then melt spun through a spin die or spinnerette to produce monofilaments having a diameter of 0.70 mm. The spin die temperature was 310° C. and blend temperature at extrusion was 327° C. After leaving the spin die, the monofilaments are quenched in a water bath located beneath the spin die. After quenching, the monofilaments are drawn and heat set. The heat setting occurs in an oven located in the third draw zone. The draw ratios are, respectively, 3.2, 1, 1, and heat set oven temperatures was 155° C.

The physical properties of the foregoing monofilaments are given in TABLE 1. "Denier" was calculated by weighing one meter lengths of the monofilament. "Hot air shrinkage" (HAS @200° C.) was calculated by placing a sample (one meter in length, coiled into a loop of about 10–11 cm in diameter) into a forced hot air oven set at 200° C. for 15 minutes, then removing the sample from the oven, letting the sample cool and finally measuring the length of the sample. "Relative elongation at one gram per denier" (Rel. Elong. @ 1G/D); "elongation at break" (Elong @ Break); and "tenacity" are measured using an Instron Tensile Tester Model #4201 set with a 500 mm gauge length, a cross head speed of 500 mm/minute, and using flat faced clamps (the monofilament running over the top of the top clamp to below the bottom of the bottom clamp). "Loop strength" and "knot strength" are measured using the Instron setup noted above, the exceptions being: for "loop"—two monofilaments are joined by intersecting loops; and for "knot"—the monofilament is tied with an overhand knot.

TABLE 1

| | | |
|---|---|---|
| Denier | 4254 | 4254 |
| Rel. Elong. @ 1 G/D (%) | 4.7 | 4.2 |
| HAS @ 200° C. (%) | 12.5 | 12.6 |
| Tenacity (G/D) | 2.21 | 2.38 |
| Loop (G/D) | 1.83 | 1.68 |
| Knot (G/D) | 1.58 | 1.42 |
| Elong. @ Break (%) | 26.7 | 26.6 |
| Diameter (mm) | 0.709 | 0.71 |

The present invention may be embodied in other specific forms without departing from the spirit or essential attributes thereof and, accordingly, reference should be made to the appended claims, rather than to the foregoing specification, as indicating the scope of the invention.

We claim:

1. A monofilament comprising a blend of: a polyester consisting essentially of a condensation product of a polyhydric alcohol component of 1,4-cyclohexane-dimethanol, and a hexacarbocyclic dicarboxylic acid; a polyamide; and a polyolefin.

2. An article of paper machine clothing used in a paper making machine, said article comprising said monofilament of claim 1.

3. The monofilament according to claim 1 wherein said polyester comprises about 70 to about 95 percent by weight of said blend, said polyamide comprises about 5 to about 20 percent by weight of said blend and said polyolefin comprises about 1 to about 6 percent by weight of said blend.

4. The monofilament according to claim 1 wherein said polyester comprises about 85 to about 95 percent by weight of said blend, said polyamide comprises about 5 to about 15 percent by weight of said blend, and said polyolefin comprises about 1 to about 3 percent by weight of said blend.

5. The monofilament according to claim 1 further comprising a hydrolysis stabilizing agent, said hydrolysis stabilizing agent comprising from about 0.5 to about 5 percent by weight of said blend.

6. The monofilament according to claim 5 wherein said hydrolysis stabilizing agent comprises a carbodiimide.

7. The monofilament according to claim 6 wherein said hydrolysis stabilizing agent comprises about 1 percent by weight of said blend.

8. The monofilament according to claim 1 further comprising a thermo-oxidative stabilizing agent, said thermo-oxidative stabilizing agent comprising from about 0.05 to about 10 percent by weight of said blend.

9. The monofilament according to claim 8 wherein said thermo-oxidative stabilizing agent comprises about 5 percent by weight of said blend.

10. The monofilament according to claim 1 wherein said polyamide is selected from the group consisting of: nylon 6, nylon 6,10; nylon 6,12; nylon 11; nylon 12; nylon 4,6; nylon 6,T; nylon 6,6; and combinations thereof.

11. The monofilament according to claim 10 wherein said polyamide is nylon 6,6.

12. The monofilament according to claim 1 wherein said polyester having a polyhydric alcohol component of 1,4-cyclohexanedimethanol further comprises a polyfunctional acid selected from the group consisting of: isophthalic acid; terephthalic acid; derivatives of isophthalic acid; derivatives of terephthalic acid; and combinations thereof.

* * * * *